US009168769B2

(12) United States Patent
Sakano

(10) Patent No.: US 9,168,769 B2
(45) Date of Patent: Oct. 27, 2015

(54) RECORDING APPARATUS

(71) Applicant: BROTHER KOGYO KABUSHIKI KAISHA, Nagoya-shi, Aichi-ken (JP)

(72) Inventor: Yuji Sakano, Toyota (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/039,280

(22) Filed: Sep. 27, 2013

(65) Prior Publication Data

US 2014/0092189 A1 Apr. 3, 2014

(30) Foreign Application Priority Data

Sep. 28, 2012 (JP) ..... 2012-218364

(51) Int. Cl.
*B41J 13/02* (2006.01)
*B41J 11/00* (2006.01)
*B41J 13/10* (2006.01)

(52) U.S. Cl.
CPC ..... *B41J 13/02* (2013.01); *B41J 11/006* (2013.01); *B41J 13/103* (2013.01)

(58) Field of Classification Search
CPC ..... B41J 11/00; B41J 3/60; B41J 13/00; B41J 13/0018; B41J 13/103; B65H 2301/42134
See application file for complete search history.

(56) References Cited

U.S. PATENT DOCUMENTS

| | | | | |
|---|---|---|---|---|
| 7,192,025 | B1 * | 3/2007 | Golicz et al. | 271/34 |
| 2003/0076399 | A1 | 4/2003 | Matsuo et al. | |
| 2005/0062827 | A1 | 3/2005 | Otsuka et al. | |
| 2008/0024808 | A1 | 1/2008 | Masuda | |
| 2010/0270728 | A1 * | 10/2010 | Hoover et al. | 271/9.01 |
| 2011/0242188 | A1 | 10/2011 | Sakano | |
| 2014/0092190 | A1 | 4/2014 | Sakano | |
| 2015/0029286 | A1 * | 1/2015 | Yagi et al. | 347/179 |

FOREIGN PATENT DOCUMENTS

| | | | |
|---|---|---|---|
| CN | 1491803 | A | 4/2004 |
| CN | 102218906 | A | 10/2011 |
| JP | H05-131696 | A | 5/1993 |
| JP | H06-161172 | A | 6/1994 |
| JP | 2003-122072 | A | 4/2003 |
| JP | 2005-280132 | A | 10/2005 |
| JP | 2008-012890 | A | 1/2008 |
| JP | 2008-032913 | A | 2/2008 |
| JP | 2009-241355 | A | 10/2009 |
| JP | 2014-080026 | A | 5/2014 |

OTHER PUBLICATIONS

Office Action issued in related Chinese patent application 201310445291.0, Jan. 6, 2015.

Office Action issued in related U.S. Appl. No. 14/039,870, Feb. 13, 2015.

* cited by examiner

*Primary Examiner* — Justin Seo

(74) *Attorney, Agent, or Firm* — Merchant & Gould PC

(57) ABSTRACT

A recording apparatus includes a first accommodating section, a transporting mechanism configured to transport the recording medium in order of a first path to a fourth path and which includes a separating mechanism, and a recording section. The separating mechanism includes a feeding roller and a separating member. The first accommodating section, the second path, and the fourth path are arranged to overlap with each other in a vertical direction.

10 Claims, 7 Drawing Sheets

RECORDING APPARATUS

CROSS REFERENCE TO RELATED APPLICATION

The present application claims priority from Japanese Patent Application No. 2012-218364, filed on Sep. 28, 2012, the disclosure of which is incorporated herein by reference in its entirety.

BACKGROUND OF THE INVENTION

1. Field of the Invention

The present invention relates to a recording apparatus configured to record an image on a recording medium.

2. Description of the Related Art

There is known an image forming apparatus including a paper feeding tray (referred to as a accommodating section) on which a plurality of recording media is stacked, a paper feeding roller (feeding roller) and a separating pad (separating member) which are configured to separate and transport the recording media stacked on the paper feeding tray, an electrostatic attraction belt which is configured to attract and transport the recording medium that has been separated and transported from the paper feeding tray, and a recording head (recording section) which records an image on the recording medium that is being transported by the electrostatic attraction belt. In this image forming apparatus, the feeding roller makes a contact with an upper surface of the recording media stacked on the paper feeding tray, and the separating pad makes a contact with a lower surface of the recording medium transported by the paper feeding roller. Accordingly, multi-feed of the recording medium is suppressed.

SUMMARY OF THE INVENTION

In the abovementioned image forming apparatus, as compared to a state of being stacked on the accommodating section, the recording medium turned upside down is transported to a position facing the recording section. Moreover, at the position facing the recording section, an image is formed by the recording section on the upper surface of the recording medium which has been turned upside down with respect to the state of being stacked on the accommodating section. The upper surface of the recording medium which has been turned upside down makes a contact with the separating member when transported from the accommodating section upon being separated. The separating member makes a contact with the recording medium and applies a transporting resistance to the recording medium. Therefore, a scratch is susceptible to occur and a foreign matter (such as paper dust) which is developed due to contacting with the separating member is susceptible to be adhered to the upper surface of the recording medium which has been turned upside down. When an image is recorded on the upper surface of such recording medium, a problem of degradation of the image arises.

According to an aspect of the present teaching, there is provided a recording apparatus configured to perform recording on a recording medium, including:

a first stacking section on which a plurality of recording media is stacked;

a transporting mechanism configured to transport a recording medium among the recording media loaded on the first stacking section in order of a first path which is configured to turn the recording medium upside down, a second path which is extended linearly, a third path which is configured to turn the recording medium upside down, and a fourth path which is extended linearly, the transporting mechanism including a separating mechanism which is configured to separate multi-fed recording media, from the first stacking section, and to transport the separated recording media to the first path; and a recording section configured to record an image on the recording medium, wherein the recording section is arranged along the fourth path, the separating mechanism includes a feeding roller configured to transport the recording medium by rotating while making a contact with an upper surface of the recording medium transported from the first stacking section, and a separating member configured to separate the multi-fed recording media transported from the first stacking section, by applying a transporting resistance by making a contact with a lower surface of the recording medium transported by the feeding roller.

Accordingly, the recording section is arranged along the fourth path, and records an image on the recording medium. Here, the recording medium transported to the fourth path is transported from the first stacking section by the separating mechanism, and after the recording medium is turned upside down twice by the first path and the third path, the recording medium is transported to the fourth path. Accordingly, the recording medium that has been transported from the first stacking section to the fourth path via the first path, the second path, and the third path, has the upper surface and the lower surface in the state of being transported to the fourth path, coinciding with the upper surface and the lower surface of the recording medium in the state of being loaded on the first stacking section. The lower surface of the recording medium in the state of being loaded on the first stacking section makes a contact with the separating member, and the transporting resistance is applied to the lower surface of the recording medium. Therefore, paper dust that is developed due to the transporting resistance being applied is adhered to the lower surface of the recording medium, or, sometimes a scratch is developed on the lower surface of the recording medium. Supposedly, when an image is recorded on the surface to which the transporting resistance has been applied by the separating member, there is a possibility that the image quality of degraded. However, in the present teaching, particularly in a case of one-sided recording, by the recording medium being turned upside down twice by the first path and the third path, since the image is recorded on the upper surface of the recording medium in the state of being loaded on the first stacking section, it is possible to suppress the degradation of image quality.

BRIEF DESCRIPTION OF THE DRAWINGS

FIG. 5A is a condition diagram when the feeding roller is at a pinched position, and FIG. 5B is a condition diagram when the feeding roller is at a released position;

DETAILED DESCRIPTION OF THE PREFERRED EMBODIMENTS

Figure 1:
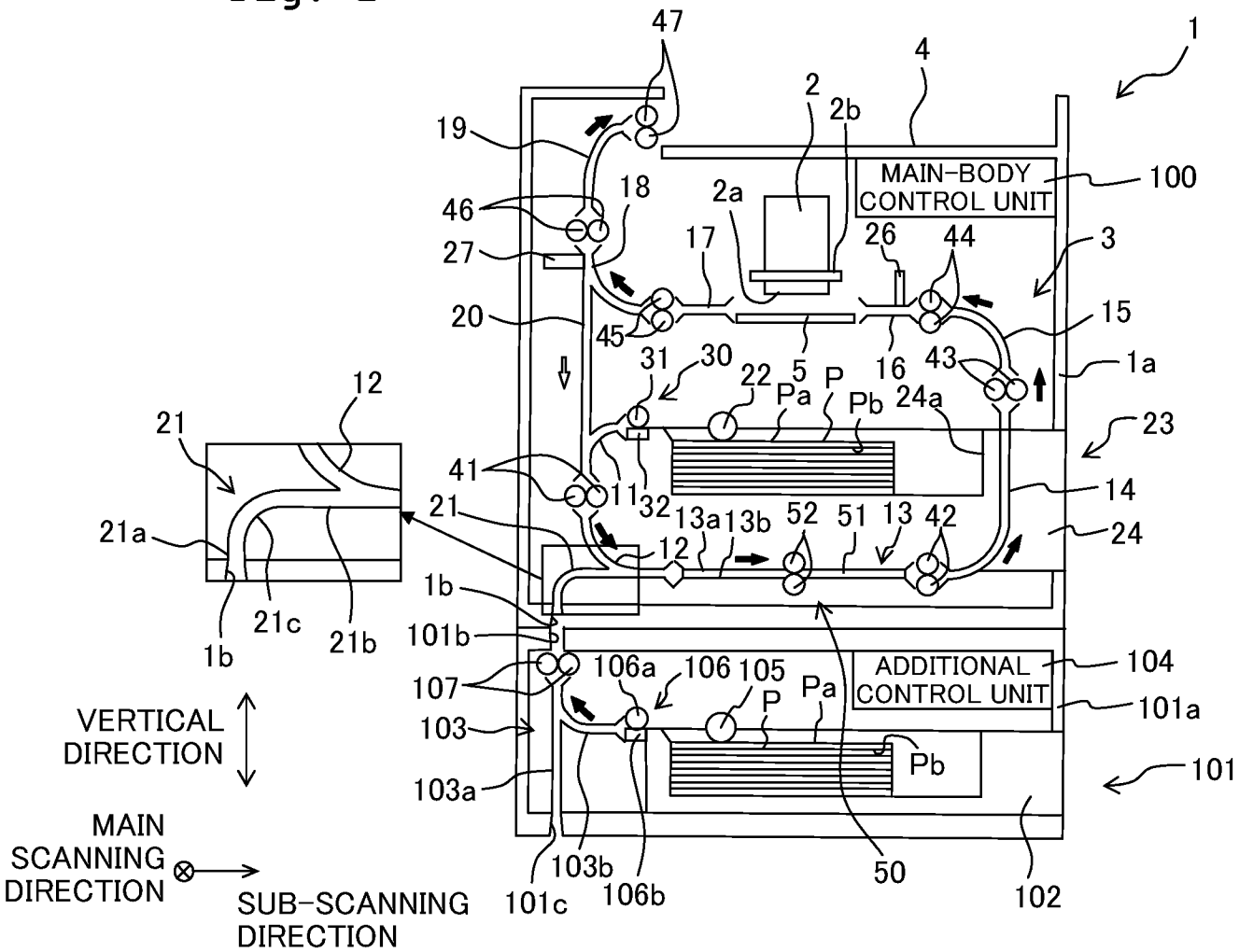
FIG. 1 is a schematic side view showing an internal structure of an ink-jet printer according to an embodiment of a recording apparatus.

Exemplary embodiments of the present teaching will be described below while referring to the accompanying diagrams.

An overall configuration of an ink-jet printer 1 (hereinafter, also referred to as a printer 1) as an embodiment of a recording apparatus according to the present teaching will be described below with reference to FIG. 1.

The printer 1 includes a housing 1*a* having a rectangular parallelepiped shape. An additional paper feeding unit (referred to as a second stacking section) 101 is installed at a lower end of the printer 1. The additional paper feeding unit 101 is detachable in a vertical direction from the printer 1. A paper discharge section (referred to as a discharge section) 4 is provided to an upper portion of a top plate portion of the housing 1*a*. A paper transporting path extending from a paper feeding section (referred to as a first stacking section) 23 toward the paper discharge section 4, a paper re-feeding path extending from a downstream side of the paper transporting path toward an upstream side of the paper transporting path, and a connecting path connected to an upstream portion of the paper transporting path are formed in an internal space of the housing 1*a*. As shown in FIG. 1, a paper P is transported along black arrow marks in the paper transporting path, and is transported along white arrow marks in the paper re-feeding path. Moreover, the paper P is transported from the additional paper feeding unit 101 to the paper transporting path, in the connecting path.

A head (referred to as a recording section) 2 configured to jet a black ink, a transporting mechanism 3, the paper feeding section 23, and a main-body control unit 100 are arranged inside the housing 1*a*. Moreover, a cartridge which is not shown in the diagram is installed inside the housing 1*a*. The black ink is stored in the cartridge. The cartridge is connected to the head 2 via a tube and a pump which are not shown in the diagram, and the ink is supplied to the head 2.

The head 2 is a line head having a substantially rectangular parallelepiped shape. A longer side of the head 2 is parallel to a main scanning direction. A lower surface of the head 2 is a jetting surface 2*a* in which a plurality of jetting ports open. At the time of recording, the black ink is jetted toward a downward direction from the jetting surface 2*a*. The head 2 is supported by the housing 1*a* via a head holder 2*b*. The head holder 2*b* holds the head 2 such that the jetting surface 2*a* forms a predetermined gap appropriate for recording, between the platen 5 (which will be described later) and the jetting surface 2*a*.

The transporting mechanism 3 includes eleven guide members 11 to 21, seven pairs of transporting rollers 41 to 47, the platen 5, a positioning mechanism 50, a separating mechanism 30, and a paper feeding roller 22. The paper feeding roller 22 is arranged at a position at which the paper feeding roller 22 makes a contact with the paper P placed in a paper feeding tray 24 which will be described later. The paper feeding roller 22 feeds the paper P in the paper feeding tray 24, by being driven by the main-body control unit 100. The platen 5 is arranged at a position facing the jetting surface 2*a*. The platen 5 having a flat surface, supports the paper P from a lower side, and forms a recording area between the jetting surface 2*a* and the platen 5. The recording area is a part of the paper transporting path and also is a part of a fourth path.

The paper transporting path is formed by a first path to a fifth path. The first path is a path which is defined by the two guide members 11 and 12, and has a path portion which is curved from the paper feeding section 23 toward the second path. The first path guides the paper P transported from the paper feeding section 23 to be directed toward a leftward direction in FIG. 1. Moreover, the first path guides the paper P transported from the paper feeding section 23 to be directed in a downward direction in FIG. 1, and thereafter, guides the paper P to be directed in a rightward direction in FIG. 1. In other words, the first path is a path that guides the paper P transported from the paper feeding section 23 to take a U-turn. In other words, the first path is a path for turning over or reversing an upper surface Pa and a lower surface Pb of the paper P in a state of being stacked on the paper feeding tray 24. The second path is a path defined by the guide member 13, and is extended linearly along a sub-scanning direction. The second path is located at a lower side of the paper feeding section 23. The transporting direction of the paper P in the second path is the rightward direction in FIG. 1. The third path is a path defined by the two guide members 14 and 15, and has a path portion which is curved from the second path toward the fourth path. The third path guides the paper P transported from the second path, to be directed toward a rightward direction in FIG. 1, and then guides the paper P to be directed toward an upward direction in FIG. 1. The third path, further guides the paper P to be directed toward a leftward direction in FIG. 1. In other words, the third path is a path that guides the paper P transported from the second path to take a U-turn, and is a path for turning the paper P transported in the second path upside down. On the second path, the upper surface of the paper P is a lower surface Pb, and the lower surface of the paper P is the upper surface Pa. The fourth path is a path that is defined by the two guide members 16 and 17, the head 2, and the platen 5, and is extended linearly along the sub-scanning direction. The fourth path is located at a position sandwiching the paper feeding section 23 between the second path and the fourth path. The transporting direction of the paper P in the fourth path is a leftward direction in FIG. 1, and is opposite to the transporting direction of the paper P in the second path. The fifth path is a path defined by the two guide members 18 and 19, and has a path portion which is curved from the fourth path toward the paper discharge section 4.

The paper re-feeding path is formed by a sixth path. The sixth path connects the fifth path and the second path, and guides the paper P transported from the fifth path to be directed toward the downward direction in FIG. 1, and further guides the paper P to be directed toward the rightward direction in FIG. 1. The sixth path goes around a recording area between the platen 5 and the head 2, and is defined by the guide member 20, a part of the guide member 11, and the guide member 12. The guide member 20 is connected to a site at some mid-point of the guide member 11. In such manner, a part of the sixth path and a part of the first path are a common path.

The pair of transporting rollers 41 is arranged at some mid-point of the first path, and between the guide member 11 and the guide member 12. The pair of transporting rollers 42 is arranged at a location where the second path and the third path are connected, and between the guide member 13 and the guide member 14. The pair of transporting rollers 43 is arranged at some mid-point of the third path, and between the guide member 14 and the guide member 15. The pair of transporting rollers 44 is arranged at a location where the third path and the fourth path are connected, and between the guide member 15 and the guide member 16. The pair of transporting rollers 45 is arranged at a location where the fourth path and the fifth path are connected, and between the guide member 17 and the guide member 18. The pair of transporting rollers 46 is arranged at some mid-point of the fifth path, and between the guide member 18 and the guide member 19. The pair of transporting rollers 47 is arranged between the guide member 19 and the paper discharge section 4. These seven pairs of transporting rollers 41 to 47 are driven by the main-body control unit 100. Accordingly, the paper P is transported in order from the first path to the fifth path, and is then discharged to the paper discharge section 4.

At the pair of transporting rollers (referred to as a pair of re-feeding rollers) 46, the transporting direction of the paper P is switched by the main-body control unit 100. In other words, in a case of transporting the paper P from the recording area to the paper discharge section 4, the pair of transporting rollers 46 is rotated such that the paper P is transported upward. On the other hand, in a case of transporting the paper P from the paper transporting path to the paper re-feeding path, a direction of rotation of the pair of transporting rollers 46 is switched such that a rear end of the paper P is transported downward as a leading end. The switching of the direction of rotation of the pair of transporting rollers 46 is carried out at a timing when the rear end of the paper P is between the pair of transporting rollers 46 and a location at which the guide member 18 and the guide member 20 are connected, and when the rear end of the paper P has been detected by a paper sensor 27. The paper P transported from the paper transporting path to the paper re-feeding path is re-fed to the second path. In this instance, the paper P to be re-fed is transported once again to the recording area in a state of being turned upside down as compared with a state in which the paper P has passed a recording area immediately prior. In such manner, it is possible to record an image on both surfaces of the paper P.

The separating mechanism 30 includes a feeding roller 31 and a friction member (referred to as a separating member) 32. The friction member 32 is arranged at a position facing the feeding roller 31, on a lower side of the feeding roller 31. The feeding roller 31 makes a contact with the upper surface Pa of the paper P that has been fed from the paper feeding tray 24 by the paper feeding roller 22. The friction member 32 is rubbed against the lower surface Pb of the paper P that is transported by the feeding roller 31. The feeding roller 31 rotates in one direction (clockwise direction in FIG. 1) by the main-body control unit 100. Moreover, a downward bias directed toward the friction member 32 is applied to the feeding roller 31 by a bias applying mechanism which is not shown in the diagram. Therefore, the feeding roller 31 is capable of transporting the paper P, to the first path, that has been fed between the feeding roller 31 and the friction member 32, and that makes a contact with the feeding roller 31. It is preferable that the friction member 32 is formed of a member having a high coefficient of friction, such as cork and rubber.

In this arrangement, even when the paper feeding roller 22 and the feeding roller 31 are rotated by the main-body control unit 100, and one paper P is transported from the paper feeding roller 22, the upper surface Pa of the paper P makes a contact with the feeding roller 31, and the paper P is transported to the first path by a rotational force of the feeding roller 31. In this instance, the lower surface Pb of the paper P moves while sliding on or rubbing against the fiction member 32. Accordingly, the paper P is subjected to transporting resistance in a direction opposite to the transporting direction. In other words, the paper P is subjected to the transporting resistance in the direction opposite to the transporting direction by the feeding roller 31. Since the friction member 32 makes a contact with the lower surface Pb of the paper P and applies the transporting resistance, a scratch or wrinkles and paper dust are susceptible to be developed on the lower surface Pb of the paper P. On the other hand, even when the paper feeding roller 22 and the feeding roller 31 rotate and a plurality of papers P is multi-fed by the paper feeding roller 22, the paper P that has made a contact with the paper feeding roller 22 is transported to the first path mainly by the feeding roller 31. In this instance, the lower surface Pb of another paper P, which is on a lower side of the multi-fed paper P, makes a contact with the friction member 32. Accordingly, another paper P is subjected to the transporting resistance in the direction opposite to the transporting direction by the friction member 32. Therefore, the another paper P is not transported in the transporting direction by making a contact with the friction member 32, and only one paper P from among the plurality sheets of the multi-fed paper P is transported to the first path. Even in this case, the lower surface Pb of the another paper P being subjected to the transporting resistance by making a contact with the friction member 32, a scratch or wrinkles and paper dust are susceptible to be developed. Moreover, in the present embodiment, when the rear end of the paper P is pinched between the feeding roller 31 and the friction member 32, the leading end of the paper P is positioned at an upstream side in the transporting direction of the head 2. Accordingly, even in a case in which a transporting accuracy is degraded due to the transporting resistance which the friction member 32 applies to the paper P, it is possible to suppress degradation of image quality. As a modified embodiment, when the rear end of the paper P is pinched between the feeding roller 31 and the friction member 32, the leading end of the paper P is positioned at a downstream side in the transporting direction of the head 2.

Figure 2:
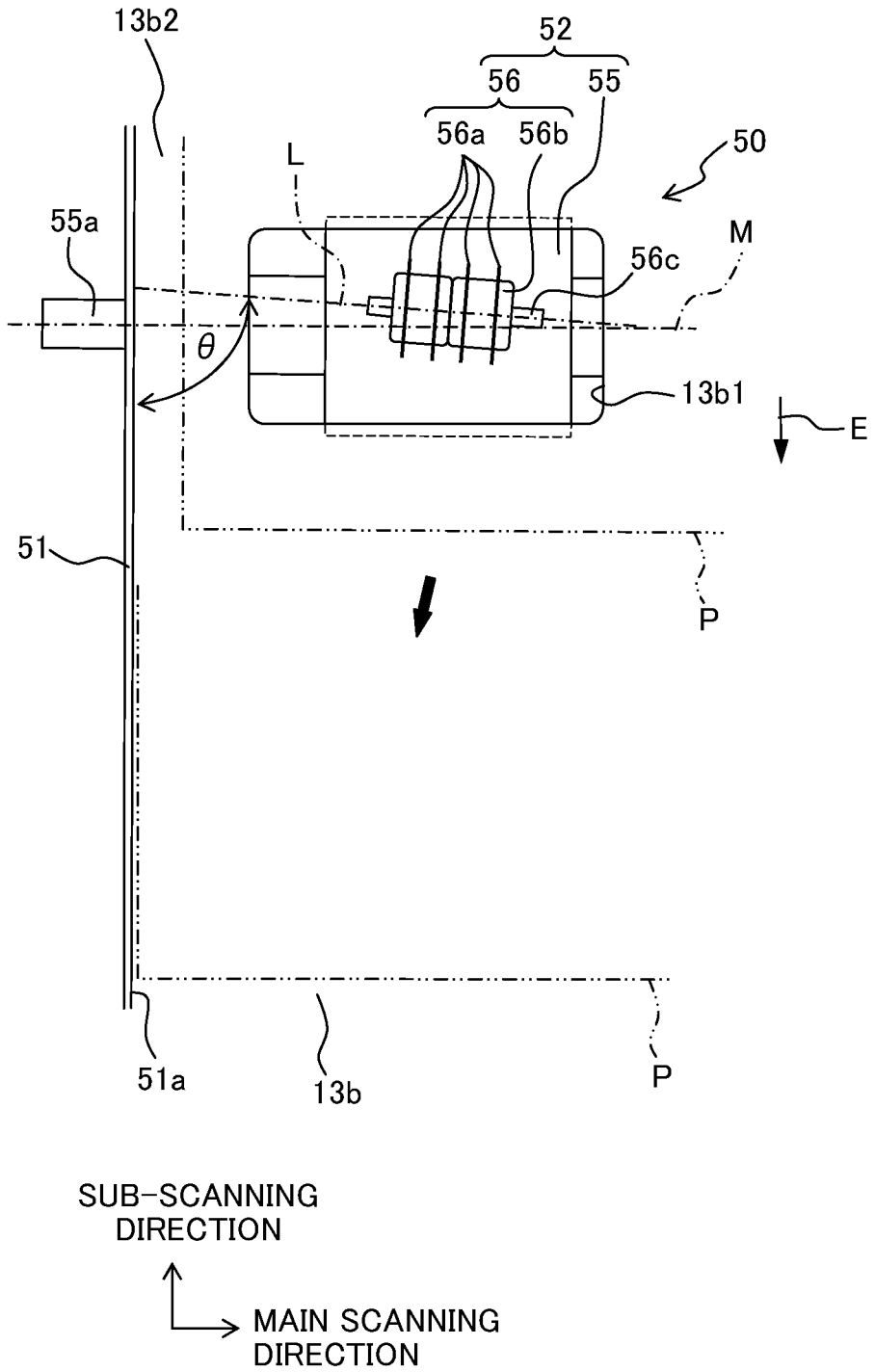
FIG. 2 is a plan view of main components of a positioning mechanism shown in FIG. 1.

As shown in FIGS. 1 and 2, The positioning mechanism 50 includes a pair of inclined feeding rollers 52 and a vertical portion 51 formed on a lower guide 13*b* of the guide member 13. The guide member 13 has an upper guide 13*a* and the lower guide 13*b*, and the upper guide 13*a* and the lower guide 13*b* are arranged to be mutually isolated or separated in a vertical direction. The second path is defined between the upper guide 13*a* and the lower guide 13*b*. Moreover, the second path is also regulated by a guide surface 51*a* of the vertical portion 51. The positioning mechanism 50 carries out the positioning of one end of the paper P in a width direction of the paper P by transporting one end in the width direction of the paper P that has been transported to the second path, while making a contact with the guide surface 51*a* (which will be described later). The direction of width is the main scanning direction, and means a direction orthogonal to the transporting direction E of the paper P (refer to FIG. 2). Here, the one end in the width direction of the paper P is an end on a side nearer to the guide surface 51*a*, out of the two ends in the width direction of the paper P.

The vertical portion 51 is formed to be erected in the vertical direction which is a direction perpendicular to a paper surface in FIG. 2 from one end (a left end in FIG. 2) in the main scanning direction of the lower guide 13*b*. The vertical portion 51 is extended along the sub-scanning direction. The guide surface 51*a* which is a vertical surface parallel to the sub-scanning direction is formed on the vertical portion 51. The guide surface 51*a* is a side surface of the vertical portion 51 which is on the other end side, out of the two side surfaces in the main scanning direction of the vertical portion 51. A length of the guide surface 51*a* in the sub-scanning direction is almost same as a length of the paper P in the sub-scanning direction. Moreover, a hole 13*b*1 is formed in the lower guide 13*b* as shown in FIG. 2. The hole 13*b*1 has a rectangular shape in a plan view, and a size of the hole 131*b* in the main scanning direction is larger than that of a drive roller 55 which will be described later, and a size of the hole 131*b* in the sub-scanning direction is slightly smaller than that of the drive roller 55. Moreover, a hole (not shown in the diagram) through which a lower-side portion of a spur roller 56 which will be described later, is exposed to the second path, is formed in the upper guide 13*a*.

The pair of inclined feeding rollers 52 includes the drive roller 55 and the spur roller 56 which faces the drive roller 55. The spur roller 56 is a driven roller which rotates with the transporting of the paper P transported by the drive roller 55 or by the rotation of the drive roller 55. As shown in FIG. 2, the drive roller 55 is arranged at a position facing the hole 13*b*1. The drive roller 55 is arranged such that an upper end thereof is slightly protruded upward from a transporting surface 13*b*2 of the lower guide 13*b*, and makes a contact with a lower surface (the upper surface Pa) of the paper P that has been transported on to the transporting surface 13*b*2. The drive roller 55 is arranged such that an axis M of the shaft portion 55*a* becomes parallel to the main scanning direction. The positioning mechanism 50 has a drive motor which is not shown in the diagram. The drive motor is driven by the control of the main-body control unit 100, and rotates the drive roller 55 via the shaft portion 55*a*.

The spur roller 56 includes four spurs 56*a* that are annular-shaped, and a roller main-body 56*b* having a circular cylindrical shape with the spur 56*a* fixed to an outer peripheral side surface thereof. A shaft portion 56*c* that becomes an axis of rotation (pivot shaft) of the spur roller 56 is formed on two end surfaces of the roller main body 56*b*. The spur roller 56 is rotatably supported by the upper guide 13*a*. The spur roller 56 is arranged such that an angle θ made by a portion at a downstream side in the transporting direction of the guide surface 51*a* of a point of intersection of an axis L of the shaft portion 56*c* and the guide surface 51*a*, and the axis L is in a range of 85° to 90°, and more preferably 88° (an acute angle).

In this arrangement, as the paper P is transported to the positioning mechanism 50 (second path) by the pair of transporting rollers 41, and as a leading end of the paper P reaches the pair of inclined feeding rollers 52, the paper P is pinched by a pair of inclined feeding rollers 53, and transported. In this instance, the drive roller 55 makes an attempt to transport the paper P in the transporting direction E. However, the axis L of the spur roller 56 is inclined. Therefore, the paper P which is shown by an alternate long and two short dashes line in FIG. 2 is transported in a direction inclined with respect to the transporting direction E. In other words, the paper P is transported in a direction shown by an arrow in FIG. 2, and a direction approaching toward the guide surface 51*a*. Accordingly, an overall left-edge of the paper P is transported in the transporting direction E while making a contact with the guide surface 51*a*. In this instance, since the paper P is transported in the transporting direction E while the left edge of the paper P making a contact with the guide surface 51*a*, it is possible to carry out positioning of the paper P in the main scanning direction.

The transporting mechanism 3 includes a hole (referred to as a receiving opening) 1*b* formed in a lower surface of the housing 1*a*. The hole 1*b* is an opening for receiving the paper P that has been transported from the additional paper feeding unit 101. The connecting path is a path which connects the hole 1*b* and the second path, and is defined by a part of the guide member 12 and the guide member 21. Moreover, the connecting path is a path for turning the paper P transported from the additional paper feeding unit 101 upside down, as compared with a state of being stacked on the paper feeding tray 102 that will be described later. The guide member 21 is connected to a site at some mid-point of the guide member 12. In such manner, a part of the connecting path and a part of the first path are a common path. More elaborately, the part of the connecting path and a part of the sixth path are a common path.

The guide member 21 includes a vertical portion 21*a* that is extended upward from the hole 1*b*, a linear portion 21*b* that is extended along the sub-scanning direction, and a curved portion 21*c* that connects the vertical portion 21*a* and the linear portion 21*b*. The linear portion 21*b* is formed such that the connecting path has a portion which is positioned to be collinear with the second path. The printer 1 according to the present embodiment is capable of recording an image on both surfaces of the paper P. The paper P having an image formed on one surface thereof is transported to the second path upon passing through the paper re-feeding path. Sometimes, there is a jamming etc. in the paper re-feeding path. In a case of jamming, sometimes an ink is adhered to a guide on a side facing the one side of the paper P on which the image is recorded, out of the pair of guides forming the guide member 12. Moreover, sometimes there is a jamming at the upstream portion of the pair of inclined feeding rollers 52 of the second path. In such case, since the one surface of the paper P on which the image is recorded faces the upper guide 13*a*, sometimes the ink is adhered to the upper guide 13*a*. In such manner, sometimes dirt is adhered to one of the pair of guides forming the guide member 12 of the paper re-feeding path, or to an upstream portion of the pair of inclined feeding rollers 52 of the upper guide 13*a*. However, since the connecting path has a linear path having the same linear shape as the second path, the ink adhered to the paper re-feeding path or the second path (upper guide 13*a*) is not susceptible to be adhered to the paper P. Concretely, the paper P transported from the additional paper feeding unit 101 passes through the curved portion 21*c*. While passing through the curved portion 21*c*, the paper P makes an attempt to regain an original state, or in other words, a flat state as when stacked in a paper feeding tray 102. In this instance, a reactive force directed toward an outer side of the curved portion 21*a* is developed. In other words, the paper P transported through the curved portion 21*c* is transported while the leading end of the paper P making a contact with an outer-side guide of the curved portion 21*c*. Next, the paper P transported from the curved portion 21*c* is inserted into the second path after passing through the linear path. Here, since the front end of the paper P is passed through the linear path, the reactive force is suppressed, and the paper P is drawn toward a lower side due to a weight of the leading end of the paper P. Therefore, when the paper P passes through the second path, the front end of the paper P comes closer to the lower guide 13*b* than to the upper guide 13*a*. Accordingly, the paper P is not susceptible to make a contact with the upper guide 13*a*. Therefore, dirt of the second path is not susceptible to be adhered to the paper P. Supposedly, if the paper P is inserted into the paper re-feeding path immediately after the curved path 21*c*, due to the reactive force of the paper P, the paper P is transported such that the leading end of the paper makes a contact with one of the pair of guides forming the guide member 12 of the paper re-feeding path, or with a portion of the upper guide 13*a* at an upstream of the pair of inclined feeding rollers 52. In other words, in a case in which the linear portion 21*b* does not exist, the dirt is susceptible to adhere to the paper P. Moreover, a straight-line portion defined by the linear portion 21*b* is shorter than a length of the guide surface 51*a*, in the sub-scanning direction. More elaborately, it is preferable that the straight-line portion has a length of about few centimeters, and has a length such that the front end of the paper P that has passed through the curved portion 21*c* is isolated from an outer-side portion (upper-side portion) of the guide member 21. Since the guide surface 51*a* carries out a function of positioning the paper P, longer the length in the sub-scanning direction of the guide surface 51*a*, better is the positioning performance. Therefore, it is preferable that the length in the sub-scanning direction of the guide surface 51*a* is not less than one third of the length of the paper P in the sub-scanning direction. In other words, since it is preferable that the straight-line portion defined by the linear portion 21*b* is shorter than the length of the guide surface 51*a* in the sub-scanning direction, it is possible to suppress an installation area of the printer 1 from becoming large.

Figure 3:
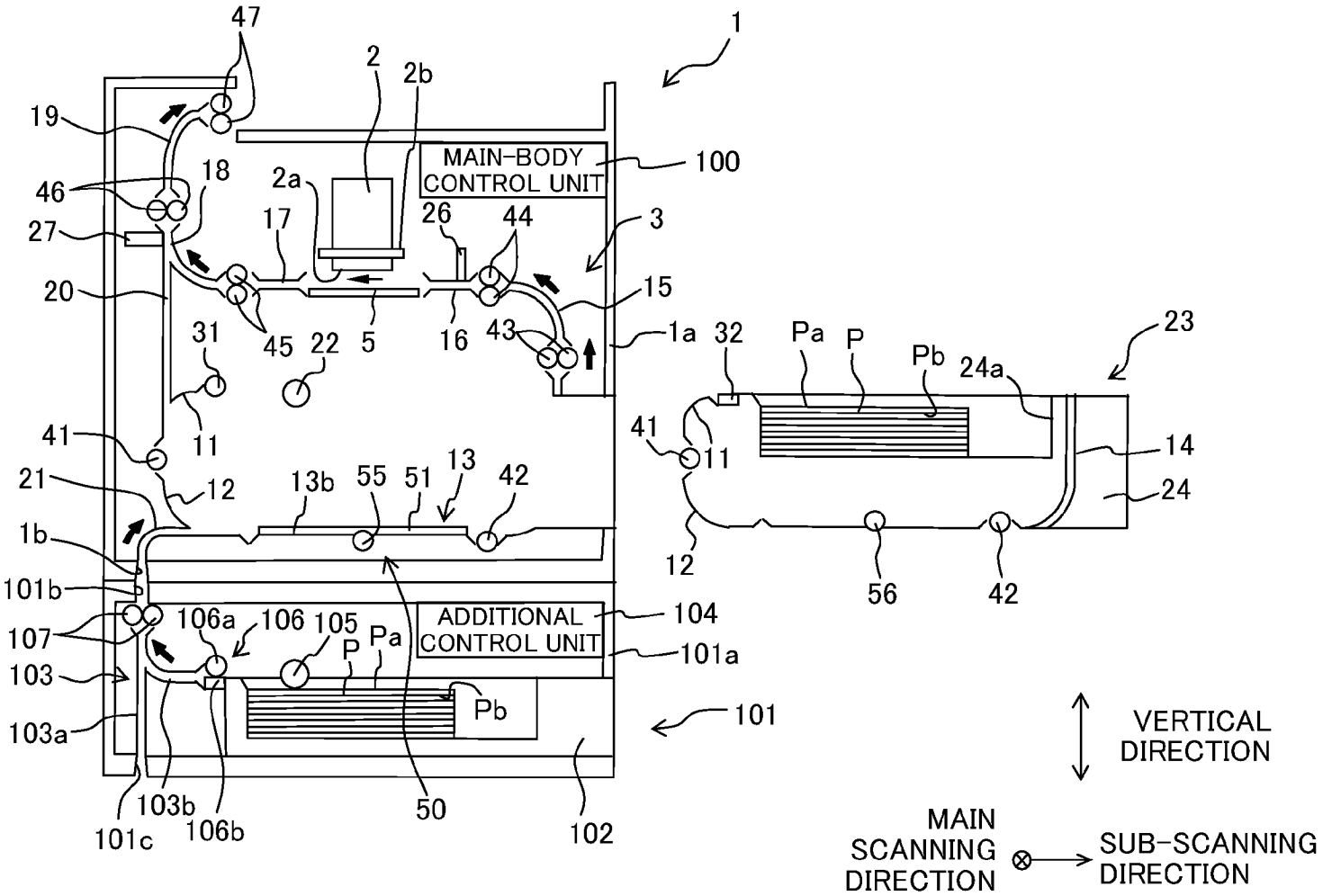
FIG. 3 is a condition diagram when a paper feeding tray is removed from a housing.

As shown in FIG. 3, the paper feeding section 23 has the paper feeding tray 24 which is detachable in the sub-scanning direction from the housing 1*a*. The paper feeding tray 24 is a box having a recess 24*a* that opens upward, and is capable of accommodating the plurality of papers P in the recess 24*a*. A part of the guide members 11 and 12, and one transporting roller from the pair of transporting rollers 41 are provided to a left-end portion of the paper feeding tray 24 as shown in FIG. 3. Concretely, a guide on a side nearer to the paper feeding tray 24 out of the pair of guides forming the guide members 11 and 12, and a roller on a side nearer to the paper feeding tray 24 out of the two rollers forming the pair of transporting rollers 41 are provided to the left-end portion of the paper feeding tray 24. A roller on a side nearer to the paper feeding tray 24 out of the two rollers forming the pair of transporting rollers 42 and the spur roller 56 is provided to a lower-end portion of the paper feeding tray 24. A pair of guides forming a part of the guide member 14 is provided to a right-end portion of the paper feeding tray 24. Moreover, the friction member 32 is provided to a left-end portion of an upper surface of the paper feeding tray 24. The paper feeding tray 24 may be detachable in the main scanning direction from the housing 1*a*. In that case, a guide on a side nearer to the paper feeding tray 24 out of the pair of guides forming the part of the guide member 14 may be provided to the right-end portion of the paper feeding tray 24.

In such manner, the upper guide 13*a* and a part of the guide members 11 and 12 which define the first path and the second path, a part of the guide member 14 which defines the third path are provided integrally to the paper feeding tray 24. Therefore, the first path, the second path, and the third path are exposed to the exterior when the paper feeding tray 24 is removed from the housing 1*a* as shown in FIG. 3. Therefore, it is possible to eliminate easily the paper P jammed in the first path, the second path, and the third path.

As shown in FIG. 1, the additional paper feeding unit 101 includes a housing 101*a*. The paper feeding tray 102, a guide section 103, and an additional control unit 104 are arranged in the housing 101*a*. The paper feeding tray 102 is detachable from the housing 101*a*. The plurality of papers P can be accommodated in the paper feeding tray 102. The additional control unit 104, based on a command from the main-body control unit 100, controls an operation of each of a paper feeding roller 105, a separating mechanism 106, and a pair of transporting rollers 107 of the guide section 103. A contact point (not shown in the diagram) which is connected to the main-body control unit 100 is provided to a lower surface of the housing 101*a* and a contact point (not shown in the diagram) which is connected to the additional control unit 104 is provided to an upper surface of the housing 101*a*. When the additional paper feeding unit 101 is installed in the printer 1, the abovementioned contact points are connected electrically, and the main-body control unit 100 and the additional control unit 104 are connected.

A discharge hole 101*b* is formed in the upper surface of the housing 101*a*. The discharge hole 101*b* is arranged at a position facing the hole 1*b*, and is an opening for discharging the paper P to the hole 1*b*. Moreover, a hole 101*c* similar to the hole 1*b* is formed in a lower surface of the housing 101*a*.

The guide section 103 includes two guide members 103*a* and 103*b*, the paper feeding roller 105, the separating mechanism 106, and the pair of transporting rollers 107. The paper feeding roller 105 feeds the paper P at the top in the paper feeding tray 102. The separating mechanism 106 has a configuration similar to the separating mechanism 30, and includes a feeding roller 106*a* and a friction member 106*b*. The feeding roller 106*a* makes a contact with the upper surface Pa of the paper P fed from the paper feeding tray 102 by the paper feeding roller 105. The friction member 106 is rubbed against the lower surface Pb of the paper P transported by the feeding roller 106*a*. According to such separating mechanism 106, it is possible to transport only one paper P out of the plurality of sheets of the paper P which is multi-fed by the paper feeding roller 105, to the guide member 103*b*.

The pair of transporting rollers 107 is arranged near the discharge hole 101*b* so that the paper P can be transported toward the discharge hole 101*b*. The guide member 103*a* is extended from the hole 101*c* up to the pair of transporting rollers 107, and forms a transporting path between the hole 101*c* and the pair of transporting rollers 107. The guide member 103*b* is extended from the paper feeding tray 102 up to a site at some mid-point of the guide member 103*a*, and forms a transporting path between the paper feeding tray 102 and the site at some mid-point of the guide member 103*a*. According to such a configuration, the guide section 103 transports the paper P from the paper feeding tray 102 and the paper P from another additional paper feeding unit, toward the printer 1. In other words, the guide section 103 transports the paper P from a lower side toward the upper side.

Next, the main-body control unit 100 and the additional control unit 104 will be described below. The main-body control unit 100 controls an operation of the overall printer 1 by controlling an operation of each section of the printer 1. The main-body control unit 100 controls a recording operation based on a recording command which has been supplied from an external device which is a device such as a PC connected to the printer 1. Concretely, the main-body control unit 100 controls operations such as an operation of transporting the paper P and an ink-jetting operation which is synchronized with the transporting of paper P. The additional control unit 104 controls the operation of transporting the paper P based on a command from the main-body control unit 100.

In a case in which a recording command for carrying out recording on one surface (in other words, the upper surface Pa) of the paper P has been received from an external device for instance, the main-body control unit 100 drives the paper feeding roller 22, the feeding roller 31, the pair of transporting rollers 41 to 47, and the pair of inclined feeding rollers 52, based on the recording command received. The paper P fed from the paper feeding tray 24 by the paper feeding roller 22 and the separating mechanism 30 is transported from the first path to the second path. At this time, the paper P is transported to the second path in a state of being turned upside down by being passed through the first path. In this state, the positioning in the main scanning direction of the paper P is carried out by the positioning mechanism 50. In this instance, the main-body control unit 100 drives the pair of transporting rollers 41 such that a transporting velocity (V1) of the paper P transported by the pair of transporting rollers 41 becomes slightly faster than a transporting velocity (V2) of the paper P transported by the pair of inclined feeding rollers 52. In other words, the main-body control unit 100 drives the pair of transporting rollers 41 such that a relationship between V1 and V2 becomes V1>V2. Accordingly, at the time of inclined-feeding of the paper P by the pair of inclined feeding rollers 52, no back-tension due to the pair of transporting rollers 41 is applied to the paper P. Therefore, it is possible to prevent defective transporting by the pair of inclined feeding rollers 52, and also to feed obliquely the paper P effectively. As a result, it is possible to transport the paper P positioned in the main scanning direction to the recording area. Next, the paper P is transported from the second path to the recording area between the platen 5 and the head 2 of the fourth path via the third path. In this instance, the paper P is transported to the fourth path in a state of being turned upside down by passing through the third path. In other words, the upper surface and the lower surface of the paper P transported to the fourth path coincide with the upper surface Pa and the lower surface Pb of the paper P in a state of being loaded on the paper feeding tray 24. In other words, the upper surface and the lower surface of the paper P in the state of being loaded on the paper feeding tray 24 are turned over twice by the first path and the third path, till the paper P is transported to the fourth path. When the paper P passes right beneath the head 2, the head 2 is controlled by the main-body control unit 100, and ink droplets are jetted from the head 2. Accordingly, a desired image is recorded on a surface (upper surface Pa) of the paper P. An operation of jetting the ink such as the timing of jetting the ink is based on a detection signal from a paper sensor 26. The paper sensor 26 is arranged at an upstream side in the transporting direction of the head 2, and detects the front end of the paper P. Next, the paper P having the image recorded thereon is discharged from the fifth path to the paper discharge section 4.

Moreover, in a case in which the main-body control unit 100 has received a recording command for recording on both surfaces of the paper P from an external device for example, the main-body control unit 100 drives the paper feeding roller 22, the feeding roller 31, the pair of transporting rollers 41 to 47, and the pair of inclined feeding rollers 52, based on the recording command. Firstly, similarly as at the time of one-sided recording, the paper P, upon having an image formed on a front surface thereof, is transported toward the paper discharge section 4. As shown in FIG. 1, the paper sensor 27 is arranged on the guide member 18 which is located at some mid-point of the transporting, near an upstream side of the pair of transporting rollers 46. As the paper sensor 27 detects the rear end of the paper P, the pair of transporting rollers 46 is rotated in reverse direction under the control of the main-body control unit 100, and a direction of transporting of the paper is reversed. In a case in which the pair of transporting rollers 41 has not been driven, the main-body control section 100 drives the pair of transporting rollers 41. Accordingly, the path for the paper P is switched, and the paper P is transported along the paper re-feeding path shown by a white arrow mark. Similarly as at the time of one-sided recording, the paper P which has been transported to the paper re-feeding path is subjected to positioning in the main-scanning direction, in the second path. Even at the time of positioning in this case, since no back-tension due to the pair of transporting rollers 41 is applied to the paper P, it is possible to feed obliquely the paper P effectively. Moreover, a recording surface of the paper P which has been re-fed from the paper re-feeding path to the second path has turned upside down. In other words, when the paper P has been transported from the paper feeding tray 24 to the second path, a recording surface of the paper P (the upper surface Pa: surface on which an image is to be recorded) is directed to be facing downward. However, when the paper P has been re-fed from the paper re-feeding path to the second path, a recording surface of the paper P (the upper surface Pa: surface on which an image has been recorded) is directed to be facing upward. Moreover, by the paper P passing through the second path and the third path, the paper P is supplied once again to the recording area upon being turned upside down, and an image is recorded on the rear surface of the paper P. Before the image recording on the rear surface, as the leading end of the paper P is detected by the paper sensor 26, the pair of transporting rollers 46 is returned to the normal rotation. The paper P subjected to double-sided recording is discharged to the discharge section 4 via the fifth path.

In a case of supplying the paper P from the additional paper feeding unit 101 instead of supplying from the paper feeding section 23, and recording an image on one side or both sides of the paper P, the additional control unit 104 drives the paper feeding roller 105, the feeding roller 106*a*, and the pair of transporting rollers 107, based on a command from the main-body control unit 100. In this instance, the main-body control unit 100 drives the paper feeding roller 22, the feeding roller 31, the pair of transporting rollers 42 to 47 except for the pair of transporting rollers 41, and also drives the pair of inclined-feeding rollers 52. For the rest of the operation, a control similar to the abovementioned control is carried out. Even in this case, the paper P fed from the paper feeding tray 102 by the paper feeding roller 105 and the separating mechanism 106 is transported to the second path upon passing through the connecting path and the transporting path regulated by the guide members 103*a* and 103*b*. At this time, the paper P is transported to the second path in a state of being turned upside down by being passed through the connecting path. Here onward, the paper P is transported similarly as mentioned above.

As it has been described above, according to the printer 1 according to the present embodiment, the head 2 is arranged along the fourth path Therefore, an image is recorded on the paper P, when the ink is jetted downward from the jetting surface 2*a*. Here, the paper P transported to the fourth path is transported from the paper feeding tray 24 by the separating mechanism 30, and thereafter, the paper P is turned upside down twice by passing the first path and the third path, and the paper P is transported to the fourth path. Accordingly, regarding an orientation of the upper surface Pa and the lower surface Pb of the paper P, the orientation of the paper P at the paper feeding tray 24 coincide with that of the paper P which has been transported to the fourth path upon passing through the first path, the second path, and the third path from the paper feeding section 23. Here, the lower surface Pb of the paper P in the state of being loaded on the paper feeding tray 24 is rubbed against the friction member 32 by being transported, and paper dust developed due to being rubbed against is adhered to the lower surface Pb. Supposedly, when an image is recorded on a surface that is rubbed against the friction member 32 in such manner, there is a possibility that the image quality is degraded. However, in the present embodiment, particularly in a case of one-sided recording, the recording medium is turned upside down twice by the first path and the second path. Therefore, since an image is recorded on the upper surface Pa at the paper feeding tray 24 which is not rubbed against the friction member 32 of the paper P, it is possible to suppress the degradation of the image quality.

Moreover, the jetting surface 2*a* of the head 2 is arranged to be horizontal and to be directed downward. The ink is jetted downward from the head 2. Since the head 2 is arranged in such manner, impurities such as paper dust are not susceptible to be adhered to the jetting surface 2*a*. Therefore, since the jetting ports formed in the jetting surface 2*a* are not covered by the impurities, it is possible to maintain the favorable jetting performance. Moreover, since the jetting surface 2*a* of the head is not directed upward and is not inclined in a direction orthogonal to the horizontal direction, degradation of jetting velocity of ink and degradation of landing accuracy of ink droplets are susceptible to occur.

Assume that a printer includes a paper feeding tray, a recording head, a separating mechanism which is configured to separate and transport a paper transported from the paper feeding tray, and a linear path through which the paper that is separated and transported passes, and which connects a path from the paper feeding tray up to the recording head. In this case, if an image is formed by the recording head on the same surface as an upper surface of the paper at the paper feeding tray, a size in the transporting direction of the printer becomes large, and the installation area becomes large. However, in the printer 1 according to the present embodiment, since the first path and the third path are curved, the second path, the fourth path, and the paper feeding section 23 are overlapped in the vertical direction. Therefore, it is possible to suppress the installation area of the printer 1 from becoming large.

The fourth path, the paper feeding section 23, and the second path are arranged in this order from the upper side. Therefore, the paper feeding section 23 is arranged between the second path and the fourth path, and it is possible to make large a radius of curvature of the third path connecting the second path and the fourth path. Consequently, it is possible to suppress the jamming of paper P in the transporting path while suppressing a height of the printer 1 from becoming large.

Moreover, the sixth path which is the paper re-feeding path, connects the fifth path and the second path. Therefore, it is possible to record an image on both surfaces of the paper P. Furthermore, it is possible to carry out positioning of the paper P in the main scanning direction even before recording an image on the rear surface of the paper P. The printer 1 according to the present embodiment can record an image on both surfaces of the paper P. However, in general, the one-side recording is more frequently performed than the two-sided recording. In such one-sided recording with a high frequency of execution, the printer 1 according to the present embodiment is capable of suppressing effectively the degradation of image quality.

Moreover, the paper P transported from the paper feeding tray 102 of the additional paper feeding unit 101 is transported to the second path upon being turned upside down in the connecting path similarly as in the first path. Note that the separating mechanism 106 is provided at some mid-point of transporting from the paper feeding tray 101 to the connecting path. Therefore, since an image is recorded on the upper surface corresponding to the upper surface Pa of the paper P at the paper feeding tray 102, it is possible to suppress the degradation of image quality.

Since there is provided the positioning mechanism 50 including the pair of inclined-feeding rollers 52 and the guide surface 51*a* for regulating the second path, it is possible to carry out positioning in the main scanning direction of the paper P that passes through the second path. Moreover, even when the positioning mechanism 50 is provided, the paper feeding section 23, the second path (corresponding to the guide member 13), the fourth path (corresponding to the guide members 16 and 17, the platen 5, and the head 2) are arranged to be overlapping in the vertical direction. Therefore, it is possible to suppress the installation area of the printer 1 from becoming large.

moreover, the pair of transporting rollers 41 is provided between the separating mechanism 30 and the pair of inclined-feeding rollers 52, in the transporting direction of the paper P. Accordingly, since it is possible to reduce an effect of a comparatively stronger or heavier transporting load due to the separating mechanism 30, it is possible to prevent defective transporting due to the pair of inclined-feeding rollers 52.

Figure 4:
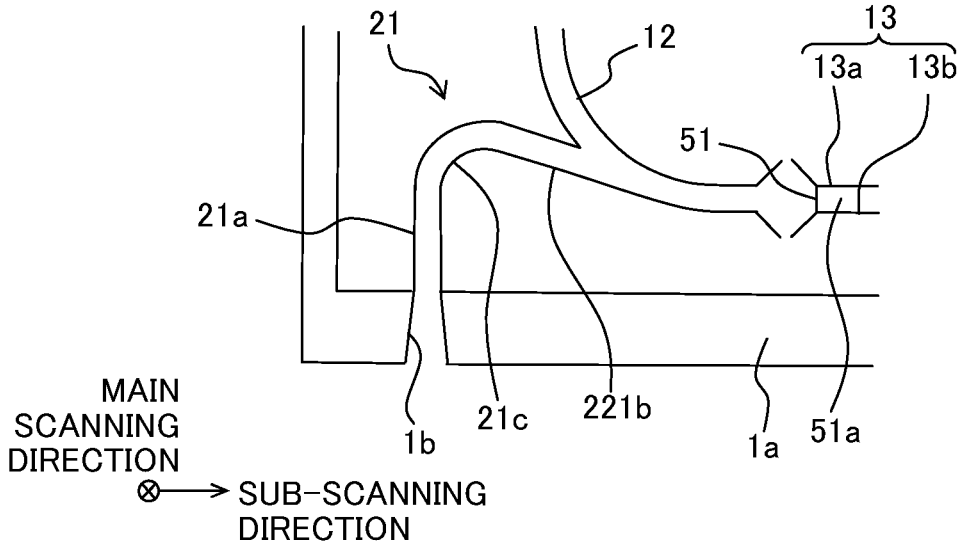
FIG. 4 is an enlarged view showing a modified embodiment of a guide member which defines a connecting path of the recording apparatus.

As a modified embodiment, a linear portion 221*b* of the guide member (referred to as a connecting path defining portion) 21 may be extended to be directed downward, with moving closer to the second path, as shown in FIG. 4. In other words, a downstream end in the transporting direction of a portion defined by the curved portion 21*c* of the connecting path is arranged on an upper side the second path, and the linear portion 221*b* is linearly extended from the downstream end toward the second path located in an inclined-right downward direction. Even in this case, the ink adhered to the paper re-feeding path or the second path (corresponding to the upper guide 13*a*) is not susceptible to be adhered to the paper P. In other words, the paper P transported from the additional paper feeding unit 101 is inserted into the second path after passing through the path regulated by the linear portion 221*b*. In this instance, when the paper P is passed through the path, the leading end of the paper P is drawn forcibly toward the lower side. Therefore, when passing through the second path, the leading end of the paper P comes closer to the lower guide 13*b* than to the upper guide 13*a*, and the paper P is not susceptible to make a contact with the upper guide 13*a*. Therefore, the dirt of the second path is not susceptible to be adhered to the paper P.

Figure 5B:
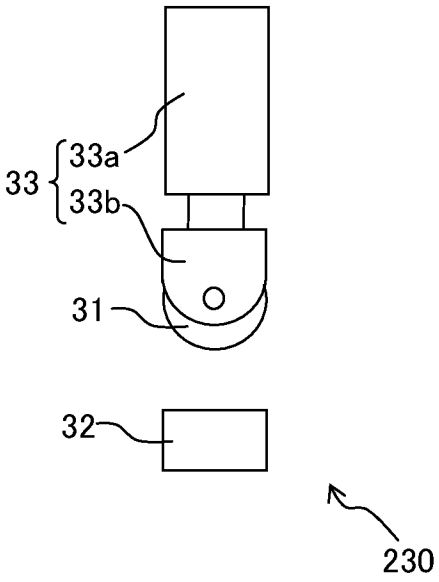
FIG. 5A and FIG. 5B show modified embodiments of a separating mechanism of the recording apparatus, where.
Figure 5A:
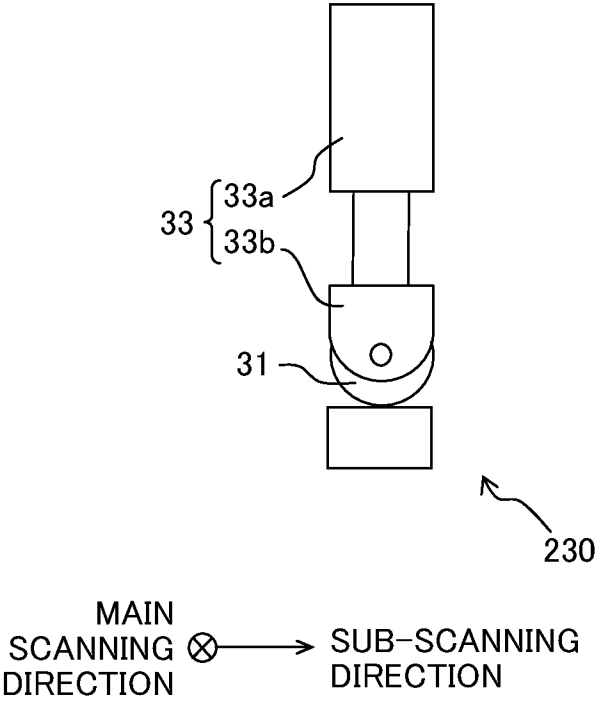

As another modified embodiment, instead of having the separating mechanism 30, the printer 1 may have a separating mechanism 230 including the feeding roller 31, and a moving mechanism 33 which moves the friction member 32 and the feeding roller 31 as shown in FIG. 5. The moving mechanism 33 includes a solenoid 33*a*, and a supporting portion 33*b* which supports the feeding roller 31. The supporting portion 33*b* is connected to a movable iron core of the solenoid 33*a*. The solenoid 33*a* of the moving mechanism 33 is activated by the main-body control unit 100, and the moving mechanism 33 moves the feeding roller 31 between a pinched position and a released position. The pinched position, as shown in FIG. 5A, is a position at which the feeding roller 31 and the friction member 32 make a mutual contact, and is a position at which the paper P is pinched. Since the feeding roller 31 is arranged at the pinched position, it is possible to transport the paper P that is fed between the feeding roller 31 and the friction member 32, and the paper P that makes a contact with the feeding roller 31, to the first path. The released position, as shown in FIG. 5B, is a position at which the feeding roller 31 and the friction member 32 are isolated, and is a position at which the paper P is ceased to be pinched.

Assuming that the paper feeding roller 22 and the feeding roller 31 arranged at the pinched position are rotated by the main-body control unit 100, and the plurality of papers P is multi-fed from the paper feeding roller 22. Even in such case, the paper P which has made a contact with the paper feeding roller 22 is transported by the feeding roller 31 to the first path, similarly as in the abovementioned embodiment. In other words, one paper P from among the plurality of sheets of the paper P that is multi-fed is transported by the feeding roller 31 to the first path, similarly as in the abovementioned embodiment. Moreover, while transporting the paper P at the time of recording an image on one surface or both surfaces thereof, the main-body control unit 100 moves the feeding roller 31 to the released position when the leading end of the paper P has reached the pair of inclined feeding rollers 52. In other words, the main-body control unit 100 controls the feeding roller 31 to release the pinched of the rear end portion of the paper P. Accordingly, at the time of feeding the paper P obliquely by the pair of inclined feeding rollers 52, no back-tension due to the separating mechanism 230 is applied to the paper P. Therefore, it is possible to prevent defective transporting by the pair of inclined feeding rollers 52, and also it is possible to feed obliquely the paper P effectively. In a case in which such separating mechanism 230 is provided, the pair of transporting rollers 41 as a pair of intermediate rollers for suppressing the back-tension of the separating mechanism 230 may not be provided. Moreover, in the present modified embodiment, the moving mechanism 33 moves the feeding roller 31. However, the moving mechanism 33 may move the friction member 32 instead of moving the feeding roller 31.

Figure 6:
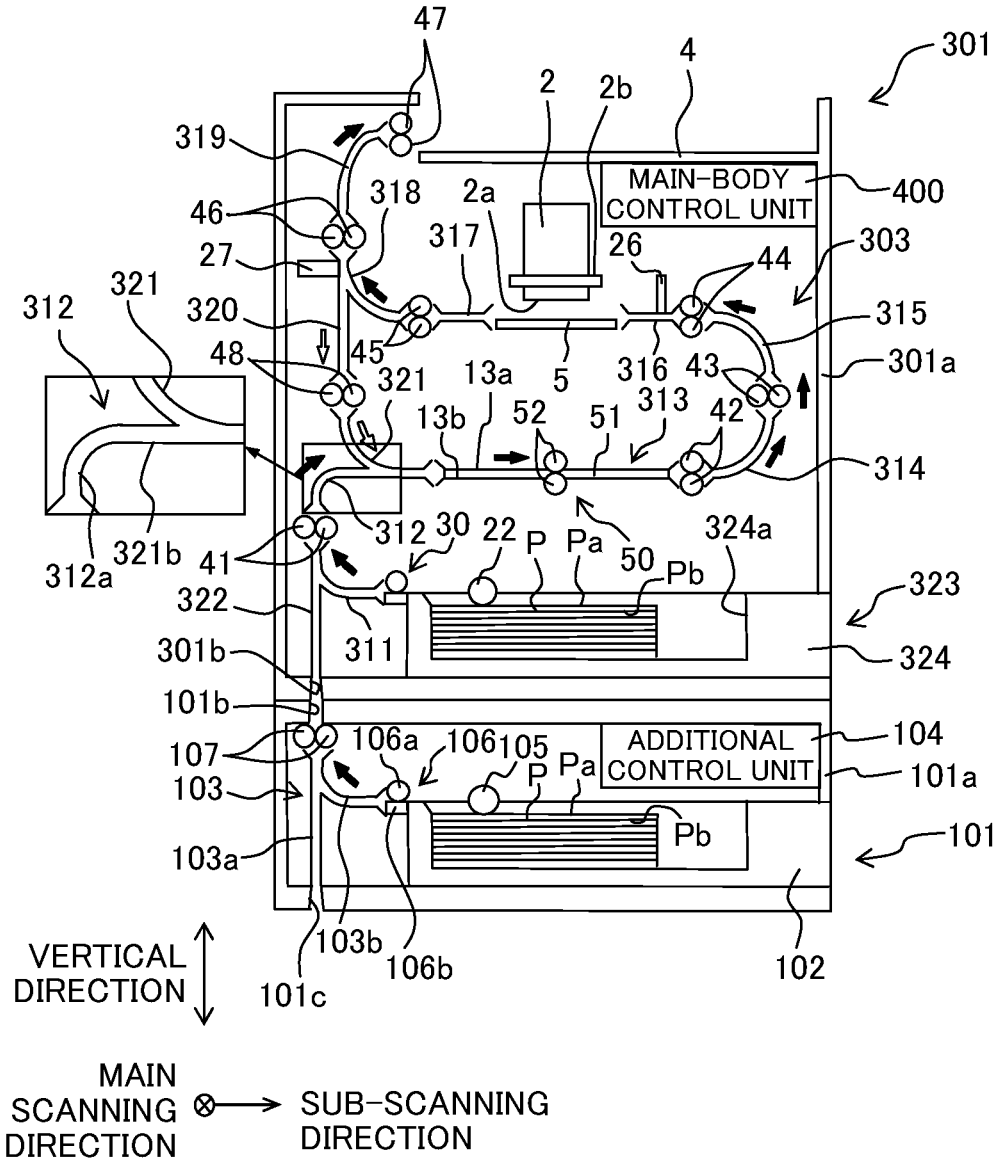
FIG. 6 is a schematic side view showing an internal structure of an ink-jet printer according to another embodiment of the recording apparatus.

Next, a printer 301 according to another embodiment of the recording apparatus according to the present teaching will be described below while referring to FIG. 6. The printer 301 according to the present embodiment is a printer in which a positional relationship of components such as the paper feeding section 23 and the guide member 31 defining the second path in the abovementioned embodiment has been changed. Since the rest of the arrangement is similar to the abovementioned arrangement of the printer 1, the same components are indicated by the same reference numerals, and description of such components is omitted.

The printer 301 includes a housing 301*a* having a rectangular parallelepiped shape. The additional paper feeding unit 101 is installed at a lower end of the printer 301. A paper transporting path that is directed from a paper feeding section 323 toward the paper discharge section 4, a paper re-feeding path that is directed from a downstream side of the paper transporting path to an upstream side of the paper transporting path, and a connecting path that is connected to an upstream portion of the paper transporting path are formed in an internal space of the housing 301*a*. The paper P, as shown in FIG. 6, is transported along thick black arrow marks in the paper transporting path, and is transported along white arrow marks in the paper re-feeding path. Moreover, the paper P is transported from the additional paper feeding unit 101 to the paper transporting path, in the connecting path.

The head (referred to as a recording section) 2, a transporting mechanism 303, the paper feeding section 323, and a main-body control unit 400 are arranged inside the housing 301*a*. The transporting mechanism 303 includes twelve guide members 311 to 322, the eight pairs of transporting rollers 41 to 48, the platen 5, the positioning mechanism 50, the separating mechanism 30, and the paper feeding roller 22. The paper feeding section 323 includes a paper feeding tray 324 which is detachable in the sub-scanning direction from the housing 301*a*. The paper feeding tray 324 is a box having a recess 324*a* opening upward, and is capable of accommodating the plurality of papers P in the recess 324*a*. The paper feeding roller 22 feeds the paper P which is at the top of the plurality of papers P stacked in the paper feeding tray 324. The guide members 313, 315, 316, 317, 318, and 319 are similar to the aforementioned guide members 13, 15, 16, 17, 18, and 19, respectively.

The paper transporting path is formed by a first path to a fifth path. The fifth path is defined by the two guide members 311 and 312, and is curved from the paper feeding section 323 to be directed toward the second path. Moreover, the first path is a path for turning the paper P transported from the paper feeding tray 324 upside down as compared with the state of being loaded on the paper feeding tray 324. The second path is located at an upper side of the paper feeding section 323, and is similar as in the aforementioned embodiment. The third path is defined by the two guide members 314 and 315, and is curved from the second path to be directed toward the fourth path. Moreover, the third path is a path for turning the paper P transported from the second path upside down as compared with a state of being transported through the second path. The fourth path and the fifth path are similar as in the aforementioned embodiment. The fourth path is located at a position sandwiching the second path between the paper feeding section 323 and the fourth path.

The paper re-feeding path is formed by a sixth path. The sixth path is a path connecting the fifth path and the second path, and goes around the recording area between the platen 5 and the head 2, and is defined by a part of the guide member 312, and the guide members 320 and 321. The guide member 321 is connected to a site at some mid-point of the guide member 312. In such manner, a part of the sixth path and a part of the first path are a common path.

The pair of transporting rollers 41 is arranged at some mid-point of the first path, and between the guide members 311 and the guide member 312. The pairs of transporting rollers 42 to 47 are arranged at positional relationship same as in the aforementioned embodiment. These seven pairs of transporting rollers 41 to 47 are driven by the main-body control unit 400. Accordingly, the paper P is transported in order from the first path to the fifth path, and is discharged to the paper discharge section 4.

The pair of transporting rollers 48 is arranged at some mid-point of the sixth path, between the guide member 320 and the guide member 321. At the pair of transporting rollers (pair of re-feeding rollers) 46 similarly as in the aforementioned embodiment, the transporting direction of the paper P is switched by the control of the main-body control unit 400. The paper P transported by the pair of transporting rollers 46 with the rear end of the paper P as the leading end, is re-fed to the second path by the pair of transporting rollers 48. In this instance, the paper to be re-fed is transported to the second path in a state of being turned upside down as compared with a state in which the paper P has passed through the recording area which is immediately prior. As a result, it is possible to record an image on both surfaces of the paper P.

The transporting mechanism 303 has a hole 301*b* formed in a lower surface of the housing 301*a*. The hole 301*b* is an opening for receiving the paper P transported from the additional paper feeding unit 101. The connecting path is a path which connects the hole 301*b* and the second path, and is defined by the guide member 322, a part of the guide member 311, and the guide member 312. The guide member 322 is connected to a site at some mid-point of the guide member 311. In such manner, a part of the connecting path and a part of the first path are a common path. More elaborately, a part of the connecting path and a part of the sixth path are a common path.

The guide member (referred to as a first path defining portion) 312 includes a curved portion 312 and a linear portion 312*b* extending along the sub-scanning direction. The linear portion 312*b*, similarly as the aforementioned linear portion 21*b*, is formed to have a straight-line portion such that, the first path has a straight-line portion which is collinear with the second path. The straight-line portion is arranged at an upstream side of the connecting portion of the second path and the sixth path in the transporting direction of the paper P. Accordingly, even in the present embodiment, since the first path has a straight-line path which is collinear with the second path similarly as in the aforementioned embodiment, the ink adhered to the paper re-feeding path or to the second path (corresponding to the upper guide 13*a*) is not susceptible to be adhered to the paper P. In other words, the paper P transported from the paper feeding tray 324 and the additional paper feeding unit 101 is inserted into the second path after passing through the linear path. In this instance, the front end of the paper P is drawn toward a lower side after passing through the linear path. Therefore, the paper P is not susceptible to make a contact with the upper guide 13*a*, and dirt of the second path is not susceptible to be adhered to the paper P.

Next, the main-body control unit 400 and the additional control unit 104 will be described below. The main-body control unit 400 controls an operation of the overall printer 301 by controlling an operation of each section of the printer 301. The main-body control unit 400 controls the recording operation based on a recording command supplied from an external device (such as a PC connected to the printer 301). Concretely, the main-body control unit 400 controls operations such as the operation of transporting the paper P and the ink-jetting operation which is synchronized with the transporting of paper P. The additional control unit 104 controls the operation of transporting the paper P based on a command from the main-body control unit 400.

In a case in which a recording command for carrying out recording on one surface (in other words, the upper surface Pa) of the paper P has been received from an external device for instance, the main-body control unit 400 drives the paper feeding roller 22, the feeding roller 31, the pairs of transporting rollers 41 to 47, and the pair of inclined feeding rollers 52, based on the recording command received. The paper P fed from the paper feeding tray 324 by the paper feeding roller 22 and the separating mechanism 30 is transported from the first path to the second path. In this instance, the paper P is transported to the second path in a state of being turned upside down by passing through the first path. In this state, the positioning of the paper P in the main scanning direction is carried out by the positioning mechanism 50. In this instance, the main-body control unit 400 drives the pair of transporting rollers 41 such that the transporting velocity (V1) of the paper P transported by the pair of transporting rollers 41 is slightly faster than a transporting velocity (V2) of the paper P transported by the pair of inclined feeding rollers 52. In other words, the main-body control unit 400 drives the pair of transporting rollers 41 such that the relationship between V1 and V2 becomes V1>V2. Accordingly, it is possible to prevent defective transporting by the pair of inclined feeding rollers 52, and it is possible to feed obliquely the paper P effectively, similarly as in the aforementioned embodiment. As a result, it is possible to transport the paper P for which the positioning in the main scanning direction has been carried out, to the recording area. Next, the paper P is transported from the second path to the recording area (in other words, the area between the platen 5 and the head 2) of the fourth path via the third path. In this instance, the paper P in transported to the fourth path in a state of being turned upside down by the paper P passing through the third path. In other words, the upper surface and the lower surface of the paper P transported to the fourth path coincide with the upper surface Pa and the lower surface Pb of the paper P at the paper feeding tray 324. When the paper P passes right beneath the head 2, the head 2 is controlled by the main-body control unit 400, and ink droplets are jetted from the head 2. Accordingly, a desired image is recorded on a front surface (the upper surface Pa) of the paper P. The operation of jetting the ink such as the timing of jetting the ink etc. is determined based on a detection signal from the paper sensor 26. The paper sensor 26 is arranged at an upstream side in the transporting direction of the head 2, and detects the leading end of the paper P. Next, the paper P having the image recorded thereon is discharged from the fifth path to the paper discharge section 4.

Moreover, in a case in which the main-body control unit 400 has received a recording command for recording on both surfaces of the paper P from an external device for example, the main-body control unit 400 drives the paper feeding roller 22, the feeding roller 31, the pairs of transporting rollers 41 to 47, and the pair of the inclined feeding rollers 52, based on the recording command. Firstly, similarly as at the time of one-sided recording, the paper P, upon having an image formed on the front surface thereof, is transported toward the paper discharge section 4. As shown in FIG. 1, the paper sensor 27 is arranged on the guide member 318 which is at some midpoint of transporting, near an upstream side of the pair of transporting rollers 46. As the paper sensor 27 detects the rear end of the paper P, the pair of transporting rollers 46 is rotated in reverse direction under the control of the main-body control unit 400, and the direction of transporting of the paper P is reversed. In this instance, the main-body control unit 400 drives the pair of transporting rollers 48. Accordingly, a path for the paper P is switched, and the paper P is transported along the paper re-feeding path shown by void arrow mark. The paper P transported to the paper re-feeding path similarly as at the time of one-side recording is subjected to positioning in the main-scanning direction, in the second path. In this instance, the main-body control unit 400 drives the pair of transporting rollers 48 such that a transporting velocity (V1) of the paper P transported by the pair of transporting rollers 48 is slightly faster than the transporting velocity (V2) of the paper P transported by the pair of inclined feeding rollers 52. In other words, the main-body control unit 400 drives the pair of transporting rollers 48 such that the relationship between V1 and V2 becomes V1>V2. Accordingly, since there is no back-tension applied to the paper P by the pair of transporting rollers 48 even at the time of positioning in this case, it is possible to feed obliquely the paper P effectively. Moreover, the paper P which has been re-fed from the paper re-feeding path to the second path has a recording surface thereof being turned upside down. In other words, a recording surface (the upper surface Pa: surface on which an image is to be recorded) of the paper P when the paper P has been transported from the paper feeding tray 324 to the second path is directed to be facing downward. However, a recording surface (the upper surface Pa: surface on which an image has been recorded) of the paper P when the paper P has been re-fed from the paper re-feeding path to the second path is directed to be facing upward. Moreover, since the paper P is passed through the second path and the third path, the paper is supplied once again to the recording area upon being turned upside down, and an image is recorded on a rear surface (corresponding to the lower surface Pb) of the paper P. Before the image recording on the rear surface, as the front end of the paper P is detected by the paper sensor 26, the pair of transporting rollers 46 is returned to normal rotation. The paper P subjected to two-sided recording is discharged to the discharge section 4 via the fifth path.

In a case of supplying the paper P from the additional paper feeding unit 101 instead of the paper feeding section 323, and recording an image on one side or both sides of the paper P, the additional control unit 104 drives the paper feeding roller 105, the feeding roller 106*a*, and the pair of transporting rollers 107, based on a command from the main-body control unit 400. For this instance, the main-body control unit 400 does not drive the paper feeding roller 22 and the feeding roller 31. For the rest of the operation, a control similar to the aforementioned control is carried out. Even in this case, the paper P which has been fed from the paper feeding tray 102 by the paper feeding roller 105 and the separating mechanism 106 is transported to the second path upon being passed through the connecting path which is partially common to the first path and the transporting path defined by the guide members 103*a* and 103*b*. In this instance, the paper P is transported to the second path in a state of being turned upside down by passing through the connecting path. From here onwards, the paper P is transported similarly as mentioned above.

As described above, even in the printer 301 according to the present embodiment, the head 2 is arranged along the fourth path, and records an image on the paper P by jetting the ink downward from the jetting surface 2*a*. Here, the paper P transported to the fourth path, is transported from the paper feeding tray 324 by the separating mechanism 30, and after the paper P are turned upside down twice by the first path and the third path, the paper P is transported to the fourth path. Accordingly, the upper surface and the lower surface of the paper P that has been transported from the paper feeding section 323 to the fourth path via the first path, the second path, and the third path, coincides with the upper surface Pa and the lower surface Pb of the paper Pat the paper feeding tray 324. Therefore, since an image is recorded on the upper surface Pa (in other words, the surface which is not rubbed against the friction member 32 of the paper P in the state of being loaded on the paper feeding tray 324, it is possible to suppress the degradation of image quality.

The fourth path, the second path, and the paper feeding section 323 are arranged in this order from the upper side. Accordingly, it is possible to use the paper feeding tray 324 and the paper feeding tray 102 in common.

Moreover, the sixth path which is the paper re-feeding path connects the fifth path and the second path. Therefore, it is possible to record an image on both surfaces of the paper P. Furthermore, it is possible to carry out positioning in the main scanning direction of the paper P even before recording an image on the rear surface of the paper P. Even in the printer 301 according to the present embodiment, an arrangement is such that it is possible to record an image on both surfaces of the paper P. However, the two-sided recording is performed less frequently as compared to the one-sided recording. In such one-sided recording with a high frequency of execution, the printer 1 according to the present embodiment is capable of suppressing effectively the degradation of image quality.

Figure 7:
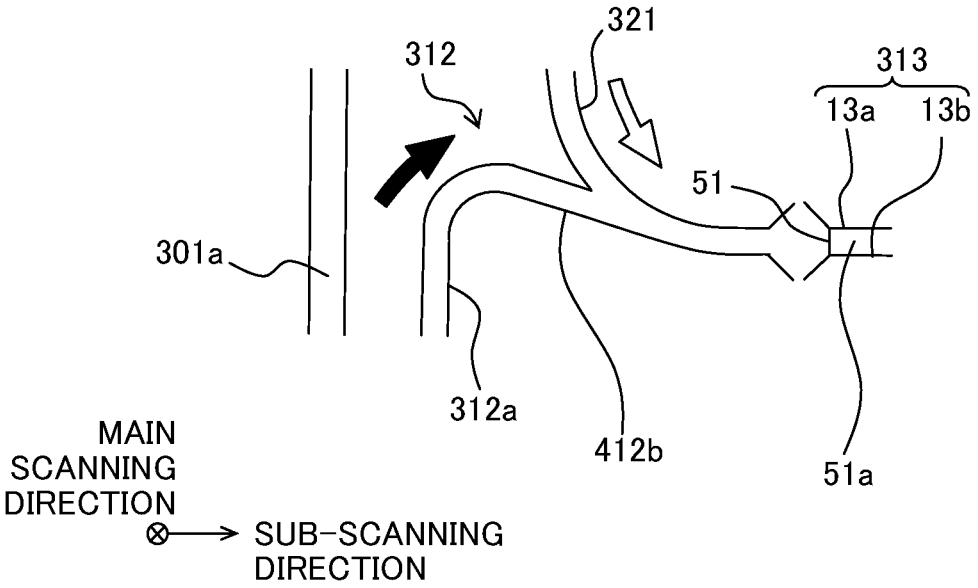
FIG. 7 is an enlarged view showing a modified example (embodiment) of a guide member which regulates a connecting path according to the another embodiment of the recording apparatus.

As a modified embodiment, a linear portion 412*b* of the guide member (referred to as a first path regulating portion) 312 may be extended to be directed downward, with moving closer to the second path as shown in FIG. 7. In other words, a downstream end in the transporting direction of a portion which the curved portion 312*a* defines, is arranged on an upper side of the second path, and the linear portion 412*b* is extended in a straight line toward the second path which is in an inclined-right downward direction from the downstream end. Even in this case, the ink adhered to the paper re-feeding path or the second path (corresponding to the upper guide 13*a*) is not susceptible to be adhered to the paper P. In other words, the paper P that has been transported from the paper feeding tray 324 and the additional paper feeding unit 101 is inserted into the second path after passing through the path regulated by the linear portion 412*b*. In this instance, the leading end of the paper P is drawn forcibly toward the lower side, by passing through the second path. Therefore, when passing through the second path, the leading end of the paper P comes closer to the lower guide 13*b* than to the upper guide 13*a*, and the paper P is not susceptible to make a contact with the upper guide 13*a*. Therefore, the dirt of the second path is not susceptible to be adhered to the paper P.

The exemplary embodiments of the present teaching have been described heretofore. However, the present teaching is not restricted to the aforementioned embodiments, and various modifications are possible within the scope of the patent claims. For instance, in the printers 1 and 301 of the embodiments, the paper re-feeding path is provided. However, the paper re-feeding path may not be provided. Moreover, in the printers 1 and 301 of the embodiments, the holes 1*b* and 301*b* which receive the paper P from the additional paper feeding unit 101, and the connecting paths which are connected to the holes 1*b* and 301*b* respectively may not be provided. In this case, to make use of the absence of the connecting paths effectively, an installation area of the printers 1 and 301 may be made small. Moreover, the linear portions 21*b*, 221*b*, 312*b*, and 412*b* may not be provided. Furthermore, the positioning mechanism 50 may not be provided. Also, the pair of transporting rollers 41 as the intermediate rollers may not be provided between the pair of inclined feeding rollers and the separating mechanism in the transporting direction. The transporting velocity (V1) of the paper P transported by the pair of transporting rollers 41 may be slower than or same as the transporting velocity (V2) of the paper P transported by the pair of inclined feeding rollers 52. Moreover, the part of the guide member 11, the part of the guide member 12, and the upper guide 13*a* may not be provided integrally to the paper feeding tray 24. Furthermore, the paper feeding tray 24 may have been provided to the housing 1*a*, to be detachable in the main scanning direction.

Moreover, the aforementioned feeding roller 31 may also function as the paper feeding roller 22. In other words, the feeding roller 31 may be arranged at a location where the paper feeding roller 22 is arranged. Accordingly, it is possible to omit the paper feeding roller 22, and an arrangement of the apparatus becomes simple. In this instance, since the lower surface of the paper P that is fed from the paper feeding trays 24 and 324 by the feeding roller 31 is rubbed against the friction member 32, even when the plurality of papers P is multi-fed from the feeding roller 31, it is possible to suppress the multi-feeding of papers P similarly as mentioned above. Moreover, in a case of the feeding roller 31 also functioning as the paper feeding roller 22, the feeding roller 31 may be arranged to face both the upper surface of the paper P loaded on the paper feeding trays 24 and 324, and the friction member 32. In other words, an arrangement may be made such that a portion of the feeding roller 31 on the upstream side of the transporting direction makes a contact with the upper surface Pa of the paper P loaded on the paper feeding trays 24 and 324, and a portion of the feeding roller 31 on the downstream side of the transporting direction makes a contact with the friction member 32.

In each of the aforementioned embodiments and the modified embodiments, the spur roller 56 has been used. However, it may be a rubber roller or a resin roller without a protrusion. Moreover, a bead roller having a plurality of protrusions on an outer peripheral side surface may be used. The abovementioned guide surface 51*a* is a vertical surface which is parallel to the sub-scanning direction. However, the guide surface 51*a* may be inclined with respect to the vertical surface in an orthogonal direction which is orthogonal to the transporting direction E.

Moreover, in each embodiment and modified embodiment, the friction member 32 has been used as an example of a separating member according to the present teaching. However, the separating member is not restricted to the friction member 32. The separating mechanism may be provided with a retard roller instead of the friction member. There are two types of retard rollers namely an active type and a passive type. The retard roller of the active type will be described below. A torque limiter is attached to the retard roller. In a case in which the retard roller has pinched one paper P between the feeding roller 31 and the retard roller, the retard roller rotates in a normal direction by being driven to be rotated by the feeding roller 31. On the other hand, in a case in which the retard roller has pinched the plurality of papers P between the feeding roller 31 and the retard roller, the retard roller rotates in a reverse direction (a direction in which the paper P is transported toward the paper feeding trays 24 and 324). The retard roller of the passive type will be described below. A torque limiter is attached to the retard roller. In a case in which the retard roller has pinched one paper P between the feeding roller 31 and the retard roller, the retard roller rotates in the normal direction by being driven to be rotated by the feeding roller 31. On the other hand, in a case in which the retard roller has pinched the plurality of papers P between the feeding roller 31 and the retard roller, the retard roller stops without rotating. In such manner, in a case in which the retard roller of the active type and the retard roller of the passive type have pinched a paper P, the retard roller of the active type and the retard roller of the passive type are driven by the feeding roller 31. However, even in the case in which one paper P is pinched, when the coefficient of friction of the lower surface Pb of the paper P is comparatively small, the retard roller, without being driven and rotated, sometimes slips on the lower surface Pb of the paper P. When the retard roller slides on the lower surface Pb of the paper P, sometimes paper dust is generated on the lower surface Pb of the paper P, or a scratch is developed on the lower surface Pb of the paper P. In such manner, the retard roller of the active type and the retard roller of the passive type have a role of a friction member which makes a contact with the paper P and applies the transporting resistance to the paper P.

The present teaching is applicable to both types namely, a line-type and a serial-type. Moreover, the present teaching is not restricted to a printer and is also applicable to a facsimile and a copy machine. Furthermore, the present teaching is also applicable to a recording apparatus of any type such as a laser type or a thermal type, provided that it is a recording apparatus that records an image. In other words, the recording section of the present teaching is not restricted to a head which jets an ink, and may be a recording section of a thermal type. Even in the recording section of laser type and the recording section of thermal type, an effect of suppressing degradation of image quality is achieved. The recording medium is not restricted to the paper P, and may be various recordable media.

What is claimed is:

1. A recording apparatus comprising:

a first accommodating section which is configured to accommodate a plurality of recording media;

a transporting mechanism configured to transport a recording medium among the recording media loaded on the first accommodating section in order of a first path which is configured to turn the recording medium upside down, a second path which is extended linearly, a third path which is configured to turn the recording medium upside down, and a fourth path which is extended linearly, the transporting mechanism including a separating mechanism which is configured to separate multi-fed recording media, from the first accommodating section, and to transport the separated recording media to the first path;

wherein the first accommodating section, the second path, and the fourth path are positioned to overlap in a vertical direction; and a recording section configured to record an image on the recording medium;

wherein the recording section is arranged along the fourth path, and the separating mechanism includes a feeding roller configured to transport the recording medium by rotating while making a contact with an upper surface of the recording medium transported from the first accommodating section, and a separating member configured to separate the multi-fed recording media transported from the first accommodating section, by applying a transporting resistance by making a contact with a lower surface of the recording medium transported by the feeding roller;

wherein the fourth path, the first accommodating section, and the second path are arranged in an order of the fourth path, the first accommodating section, and the second path from an upper side.

2. The recording apparatus according to claim 1, further comprising: a discharge section configured such that a recording medium on which the recording has been carried out by the recording section, is discharged to the discharge4i-discharge section, wherein the transporting mechanism includes: a fifth path defining portion defining a fifth path which connects the fourth path and the discharge section, a sixth path defining portion defining a sixth path which connects the fifth path and the second path, and a pair of re-feeding rollers configured to transport the recording medium to the second path via the sixth path, upon inverting a direction of advancement of the recording medium such that a rear end of the recording medium that has been transported to the fifth path becomes a leading end.

3. The recording apparatus according to claim 2, wherein a second accommodating section which is configured to accommodate a plurality of recording media is detachable at a lower side of the first accommodating section, and from the first accommodating section and the second accommodating section are overlapped in the vertical direction, and the transporting mechanism includes a receiving opening formed to receive the recording medium that has been transported from the second accommodating section, and a connecting path defining portion defining a connecting path which connects the receiving opening and the second path, and which is configured to turn the recording medium loaded on the second accommodating section upside down.

4. The recording apparatus according to claim 3, wherein the connecting path defining portion defines the connecting path such that the connecting path has a portion which is positioned to be collinear with the second path.

5. The recording apparatus according to claim 3, wherein the connecting path defining portion defines the connecting path such that the connecting path, with moving closer to the second path, has a portion that is extended to be directed further downward.

6. The recording apparatus according to claim 1, further comprising: a housing configured to accommodate the first accommodating section, the transporting mechanism, and the recording section, wherein the first accommodating section is configured to be detachable from the housing, and the transporting mechanism includes a first path defining portion defining the first path, a second path defining portion defining the second path, and a third path defining portion defining the third path, and at least a part of each of the first path defining portion, the second path defining portion, and the third path defining portion is provided integrally to the first accommodating section.

7. The recording apparatus according to claim 1, wherein the fourth path, the second path, and the first accommodating section are arranged in order of the fourth path, the second path, and the first accommodating section from the upper side.

8. The recording apparatus according to claim 7, further comprising:

a discharge section configured such that a recording medium on which the recording has been carried out by the recording section, is discharged to the discharge section, wherein the transporting mechanism includes a fifth path defining portion defining a fifth path which connects the fourth path and the discharge section, a sixth path defining portion defining a sixth path which connects the fifth path and the second path, and a pair of re-feeding rollers configured to transport the recording medium to the second path via the sixth path, upon inverting a direction of advancement of the recording medium such that a rear end of the recording medium that has been transported to the fifth path becomes a leading end.

9. The recording apparatus according to claim 8, wherein the transporting mechanism includes a first path defining portion defining the first path, and the first path defining portion defines the first path such that the first path has a portion which is positioned to be collinear with the second path, at an upstream side in the transporting direction of the recording medium, than a position at which the second path and the sixth path are connected.

10. The recording apparatus according to claim 8, wherein the transporting mechanism includes a first path defining portion defining the first path, and the first path defining portion defines the first path such that the first path has a portion which is extended to be directed further downward, with moving closer to a position at which the second path and the sixth path are connected.

* * * * *